US005722263A

United States Patent [19]

Tassotti

[11] Patent Number: 5,722,263

[45] Date of Patent: Mar. 3, 1998

[54] WASHING MACHINE WITH DYNAMIC WATER INLET CONTROL ARRANGEMENT

[75] Inventor: Gianluca Tassotti, Pordenone, Italy

[73] Assignee: Electrolux Zanussi Elettrodomestici, Pordenone, Italy

[21] Appl. No.: 583,337

[22] Filed: Jan. 5, 1996

[30] Foreign Application Priority Data

Jan. 12, 1995 [IT] Italy ..... PN95A0005

[51] Int. Cl.[6] ..... D06F 33/02; D06F 39/08; A47L 15/42

[52] U.S. Cl. ..... 68/12.02; 68/12.19; 68/207; 68/208; 134/57 D; 137/387

[58] Field of Search ..... 134/57 D; 68/12.02, 68/12.19, 207, 208; 137/387

[56] References Cited

U.S. PATENT DOCUMENTS

| | | | |
|---|---|---|---|
| 3,478,757 | 11/1969 | Tuthill | 134/57 D X |
| 4,097,307 | 6/1978 | Geiger | 134/57 D X |
| 5,409,023 | 4/1995 | Santarossa et al. | 134/57 D |

FOREIGN PATENT DOCUMENTS

| | | | |
|---|---|---|---|
| 1207409 | 7/1986 | Canada | 134/57 D |
| 0118719 | 9/1984 | European Pat. Off. . | |
| 0268835 | 6/1988 | European Pat. Off. . | |
| 2577788 | 8/1986 | France | 134/57 D |

*Primary Examiner*—Philip R. Coe
*Attorney, Agent, or Firm*—Pearne, Gordon, McCoy & Granger LLP

[57] ABSTRACT

Dishwashing machine including a valve (7) that is open during a water inlet phase and a circulation pump (11) that is energized during the water inlet phase. A control arrangement is driven by a signal (V) that is proportional to the outlet pressure of the circulation pump so as to close the inlet valve (7) when signal variations decrease below a predetermined value. The circulation pump (11) is driven by a single-phase asynchronous motor (14) with a phase-shift capacitor (15) from which the signal (V) is derived. A further signal (U) can be derived from the capacitor (15) to drive the control arrangement so as to determine the correct de-energization of a discharge pump (18).

3 Claims, 4 Drawing Sheets

WASHING MACHINE WITH DYNAMIC WATER INLET CONTROL ARRANGEMENT

BACKGROUND OF THE INVENTION

The present invention refers to a washing machine, such as clothes washing or dishwashing machine, of the type in which water being filled into a wash vessel is circulated in a closed circuit by a circulation pump and is finally let out by means of a discharge pump. In particular, the present invention refers to a washing machine provided with a control arrangement which is adapted to precisely determine the amount of water which is let into the wash vessel.

A dynamic control arrangement is known, for instance from the disclosure in EP-A-O 118 719, that is adapted to control the operation of a water inlet valve of a dishwashing machine wherein the circulation pump is operating during the water inlet phase to be controlled. A specially provided transducer means delivers a control signal that is proportional to the delivery pressure of the pump and substantially comprises a direct-current component and damped oscillating component. When the amplitude of the variations of the control signal decreases below a predetermined value, the water inlet valve is shut off.

Such a control arrangement may operate on the basis of any physical quantity that is representative of the delivery pressure of the water circulating pump. For instance, such a quantity may be correlated to the flow rate or the rotating speed of the pump, or to the active power input of the driving motor of the pump. In particular, the quantity may be the phase shift between the voltage and the current of said motor.

In principle, such a control arrangement enables water fill phases to be carried out which are optimally and very accurately controlled regardless of the variables that may be introduced by the water supply system, such as for instance the delivery pressure of the water supply mains. On the other hand, such a control arrangement calls for the utilization of relatively expensive electronic components. In particular, it requires the use of a transducer of a particularly sophisticated type, which may not be reliable. Furthermore, the need arises for the application of special means adapted to amplify the control signal in order to provide an adequate definition of the same signa.

SUMMARY OF THE INVENTION

It would therefore be desirable, and is a purpose of the present invention, to provide a washing machine comprising a dynamic water inlet control arrangement, which is particularly accurate in its operation, although making use of only a small number of substantially simple, reliable and unexpensive component parts.

It is a further purpose of the present invention to provide a washing machine of the above-cited kind, in which the dynamic water inlet control arrangement is capable of controlling also the operation of the discharge pump in a simple, but particularly effective manner.

According to the present invention, such aims are reached in a washing machine with a dynamic water inlet control arrangement having the characteristics and features as recited in the appended claims.

BRIEF DESCRIPTION OF THE DRAWINGS

The characteristics and the advantages of the present invention will be more clearly understood from the description which is given below by way of non-limiting example with reference to the accompanying drawings, in which.

DETAILED DESCRIPTION OF THE PREFERRED EMBODIMENTS

Figure 1:
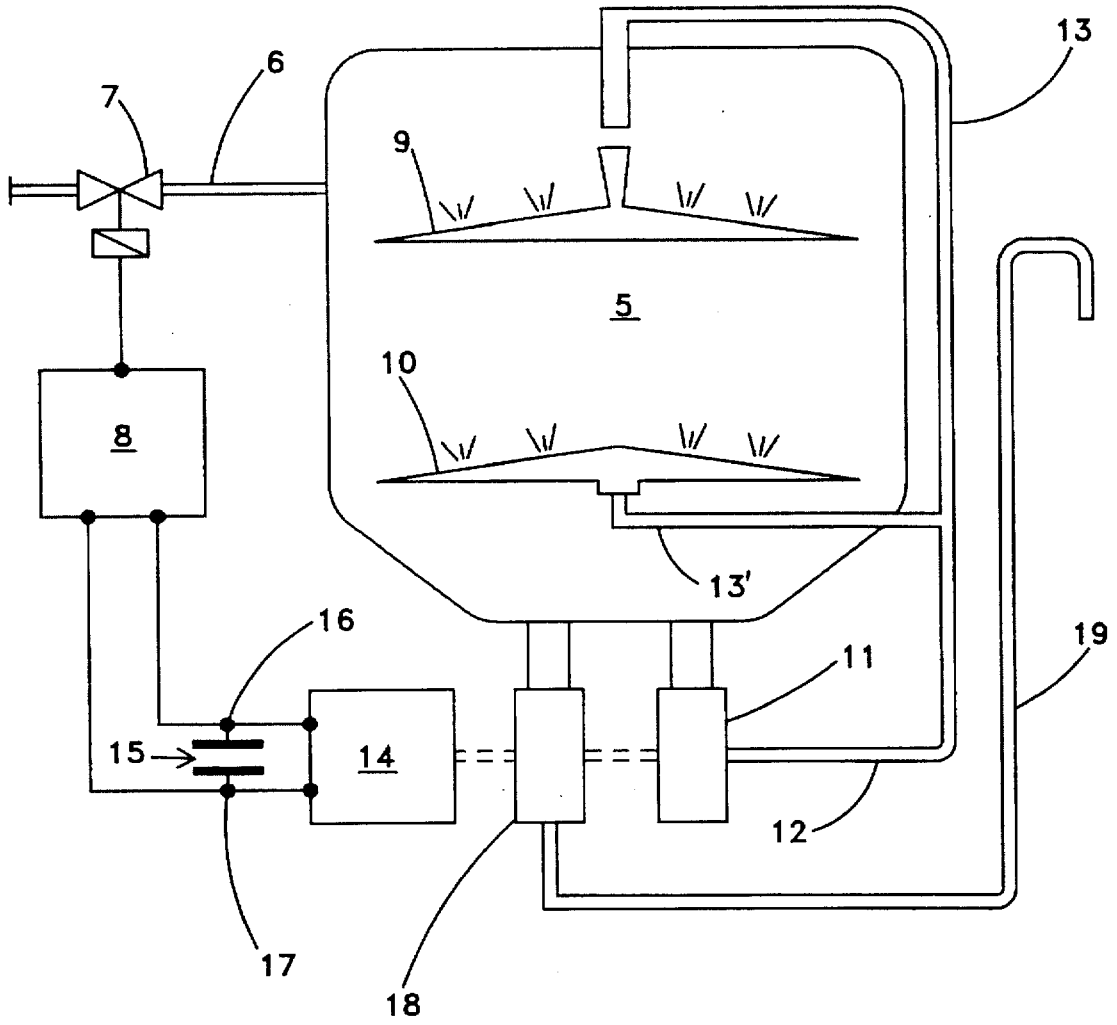
FIG. 1 is a basic schematical view of a washing machine according to the present invention.

With particular reference to FIG. 1, the washing machine described can be a clothes washing machine, but is preferably a household-type dishwashing machine. A wash vessel 5 can be supplied with mains water through a conduit 6 provided with an electromagnetic valve 7, or the like, controlled by a program sequence control unit 8 of the washing machine.

In a known manner, the wash vessel 5 houses an upper rotating spray arm 9 and a lower rotating spray arm 10. The spray arms are adapted to be supplied by a circulation pump 11 with water that the circulation pump takes in from the bottom of the wash vessel 5. In particular, the rotating spray arms 9 and 10 are connected with the delivery side (or outlet) 12 of the circulation pump 11 through appropriate conduits 13, 13'.

The circulation pump 11 is driven by an electric motor 14, which is controlled by the program sequence control unit 8 of the machine, according to one feature of the present invention, the motor 14 is a single-phase asynchronous motor of the type adapted to be started to rotate by means of phase-shifting capacitor 15. As described in a more detailed manner further on, opposite terminals 16, 17 of the capacitor 15 are preferably connected to corresponding driving inputs of the program sequence control unit 8.

In a known manner, the dishwashing machine also includes a discharge pump 18. The discharge pump is controlled by the program sequence control unit 8 of the machine and is adapted to deliver to an outlet pipe 19 the water that had previously been filled into the wash vessel 5 of the machine.

In a preferred manner, the discharge pump 18 is arranged so as to be driven by the asynchronous driving motor 14. For driving the two pumps 11, 18, the motor 14 is a reversing type, such as described in EP-A-0 268 835. In particular, the circulation pump 11 and the discharge pump 18 are capable of being driven selectively when the driving shaft of the motor 14 rotates in a first or in a second direction, respectively. In other words, when the motor 14 is driven to rotate in one direction, only the circulation pump 11 will be operating. On the contrary, when the motor 14 is caused to rotate in the opposite direction, only the discharge pump 18 will be driven.

Figure 2:
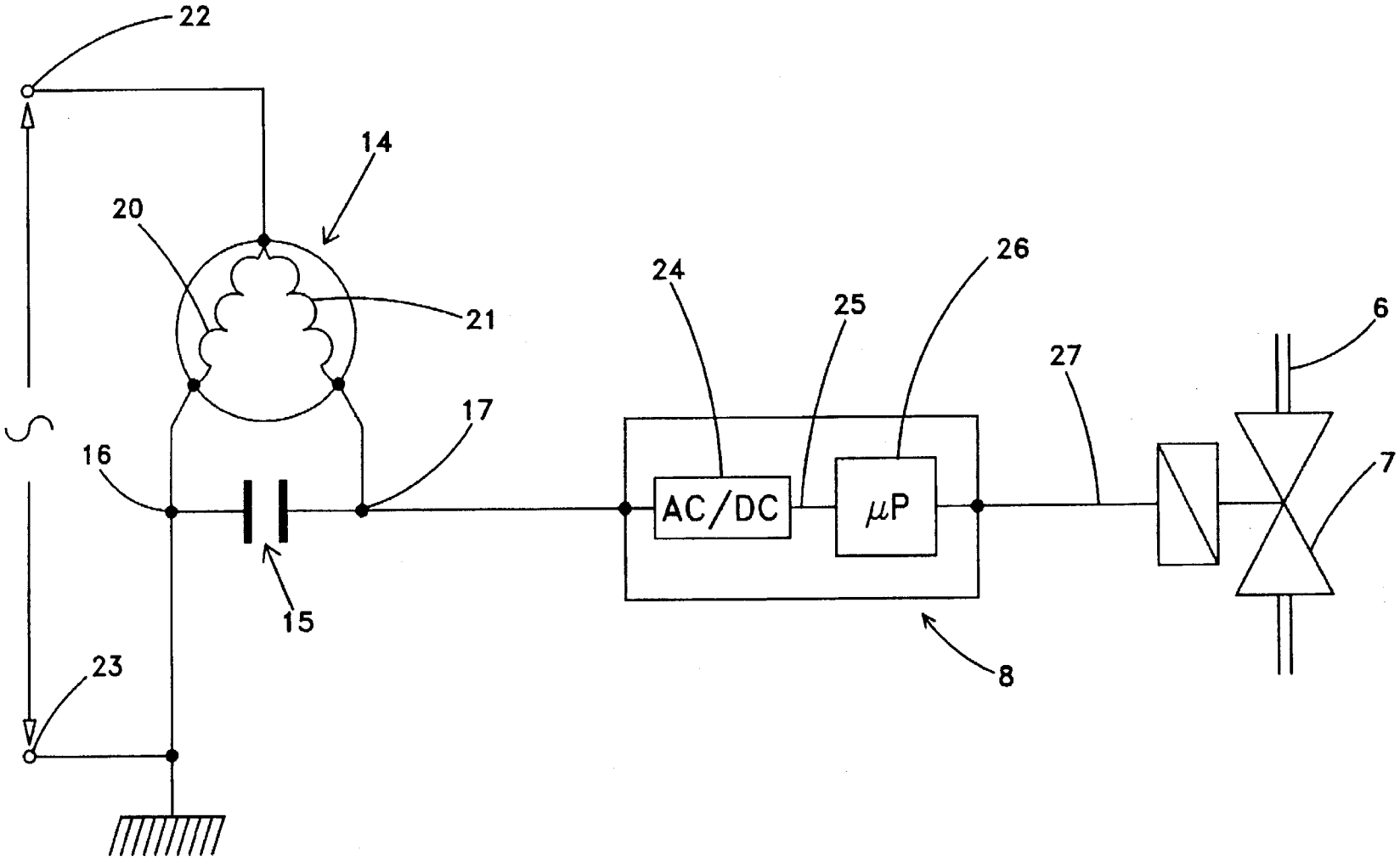
FIGS. 2 and 3 are schematic views of electric circuits of the control arrangement of the washing machine according to respective embodiments of the present invention.

With reference also to FIG. 2, the asynchronous motor 14 includes a pair of stator windings 20, 21. An end of the pair is connected to an energization terminal 22. The opposite end of the one winding 20 is connected to a second energization terminal 23 (which in a preferred manner is connected to ground), as well as to one terminal 16 of the capacitor 15.

The opposite end of the other winding 21 is connected to the opposite terminal 17 of the phase-shift capacitor 15. A substantially sine-wave supply voltage, such as for instance 220 VAC, is applied across the energization terminals 22 and 23. The second terminal 17 of the phase-shift capacitor 15 is connected, via an AC/DC converter 24, to a driving input 25 of a microprocessor 26. This microprocessor, together with the converter 24, forms a dynamic control arrangement, which is part of the program sequence control unit 8 of the machine and includes an output 27 that, in a known manner, is adapted to drive the electromagnetic or similar valve 7.

Figure 4:
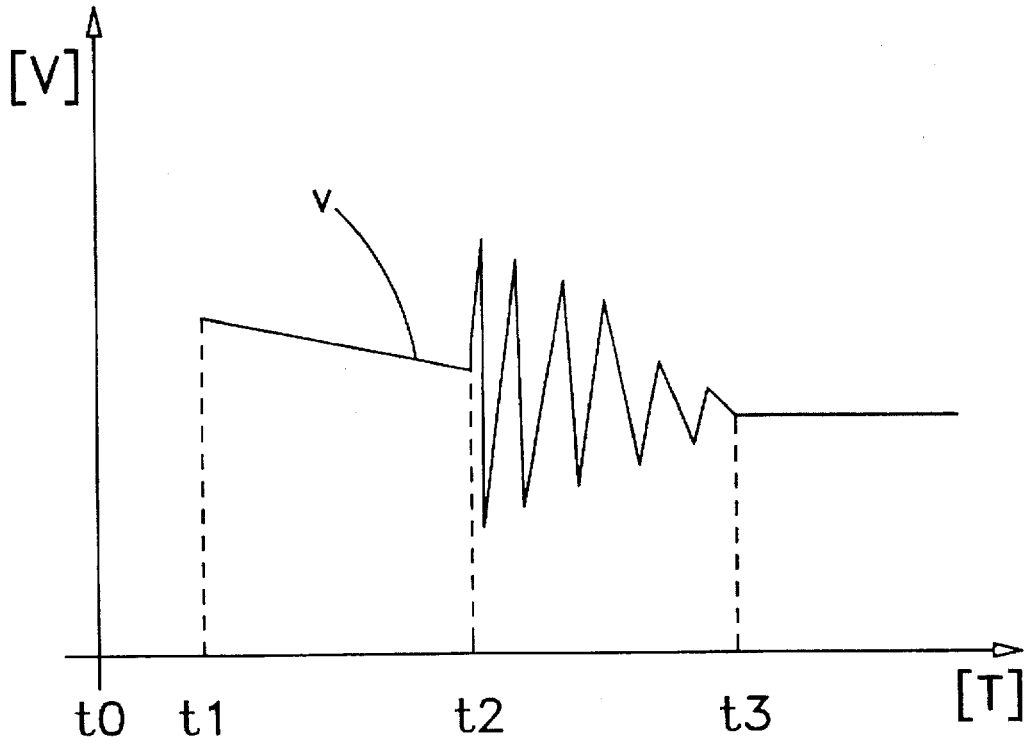
FIGS. 4 and 5 are diagrammatical views showing, in a simplified form, respective signals processed in the control arrangement of the washing machine.

Referring now also to FIG. 4, an example of the manner in which water is filled into the wash vessel 5 of the dishwashing machine is described. At an instant $t_0$, the program sequence control unit 8 of the machine causes the electromagnetic valve 7 to open and, at an instant $t_1$, the unit then causes the motor 14 to be energized. The motor 14 therefore starts to rotate, thereby driving the circulation pump 11 in a direction of rotation that is determined by the phase-shift capacitor 15. A voltage signal V substantially proportional to the water outlet or delivery pressure of the circulation pump 11 develops across the terminals 16, 17 of the capacitors 15. Specifically, the voltage signal V is substantially inversely proportional to the water outlet pressure of the circulation pump 11. As a result, the voltage signal V tends to decrease with time, until, at an instant $t_2$ at which the circulation pump 11 starts to prime, a damped oscillation starts to appear in the voltage signal V. The damped oscillation represents, in a substantially known manner, the operational conditions of the pump 11.

Through the converter 24, the voltage signal V drives the microprocessor 26 which, in a known manner thereby causes the electromagnetic valve 7 to close when, at an instant $t_3$, the variations of the signal V decrease to a level below a pre-determined value. In other words, when the component parts involved are appropriately sized, the electromagnetic valve 7 is caused to close as soon as the smallest amount of water has been filled into the wash vessel 5 of the dishwashing machine as required to enable the circulation pump 11 to prime in an optimum manner.

As already stressed above, this is an inherently known scheme. However, according to the present invention, the instant $t_3$ is determined without any need for special transducer means to be employed in view of delivering a control signal which is proportional to the outlet or delivery pressure of the pump 11. The control signal V is directly derived (with respect to ground) at the second terminal 17 of the phase-shift capacitor 15 which therefore, according to the present invention, performs a double duty in that it starts the rotation of the motor 14 and supplies an appropriate control signal to the microprocessor 26.

In addition, in a quite advantageous manner, the dynamic control arrangement of the washing machine according to the present invention does not require any amplifier for the control signal V, which is available across the terminals of the capacitor 15 in an already amplified form, for instance with a value of approximately 700 V. This is due particularly to the fact that, by applying a substantially sine-wave supply voltage (220 V) to the energization terminals 22, 23, the same current I flows through impedances represented by the winding 21 and the capacitor 15 of the motor 14. Correspondingly, across the terminals of the impedances 21 and 15 (an inductive impedance and a capacitive one, respectively) respective voltage drops form which are vectorially opposite with respect to each other and the modulus of which is directly proportional to the value of the respective impedances. In a normal single-phase asynchronous motor 14 the capacitive impedance 15 is substantially greater than the inductive impedance 21, therefore the absolute value of the voltage V derived at the terminals of the capacitor 15 is substantially amplified, as this has already been explained above.

According to the present invention, therefore, the capacitor 15 also performs a further duty in that it amplifies the control signal V which, as a result, has an advantageously high definition and allows for an accurate driving of the dynamic control arrangement 24, 26.

Figure 3:
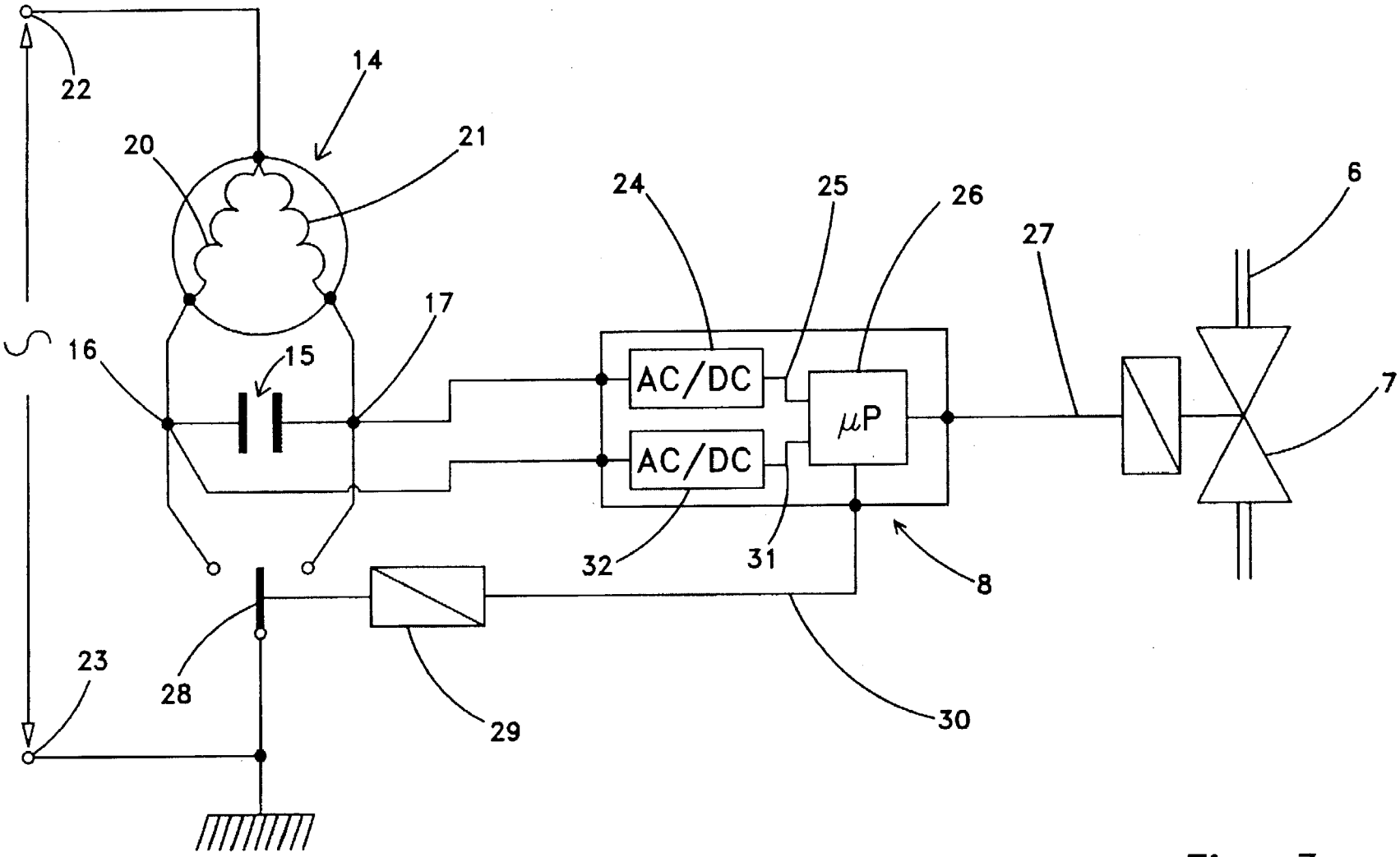

Through simple modifications, explained in greater detail with reference to FIG. 3, the washing machine according to the present invention can further be enabled to control effectively water outlet phases in which the water is let out of the wash vessel 5, particularly in the preferred case in which the circulation pump 11 and the discharge pump 18 are both driven by the same asynchronous motor 14, such as previously described.

The motor 14 is reversible by a change-over switch or reversing switch 28 controlled via a relay 29 or the like. The relay is driven by an additional output 30 of the microprocessor 26. The microprocessor has another input 31 that is connected, via another AC/DC converter 32, to the first terminal 16 of the phase-shift capacitor 15. In particular, the change-over switch 28 has a "disconnected" resting position shown in FIG. 3 and can be selectively switched over to first and second operational or active positions in which the switch energizes the motor 14 via the first terminal 16 and the second terminal 17, respectively, of the phase-shift capacitor 15.

When the change-over switch 28 is connected to the first terminal 16, the motor 14 is operated to rotate in a first direction of rotation, in which only the circulation pump 11 is operating. In this particular condition, the control signal V is derived at the second terminal 17 of the capacitor 15 and drives the input 25 of the microprocessor 26 in the afore-described manner.

When the change-over switch 28 is connected to the second terminal 17, the motor 14 is operated to rotate in the opposite direction of rotation, in which only the water discharge pump 18 is operating. In this particular condition, the input 31 of the microprocessor 26 is driven, via the converter 32, by a second voltage signal U derived at the first terminal 16 of the phase-shift capacitor 15.

Figure 5:
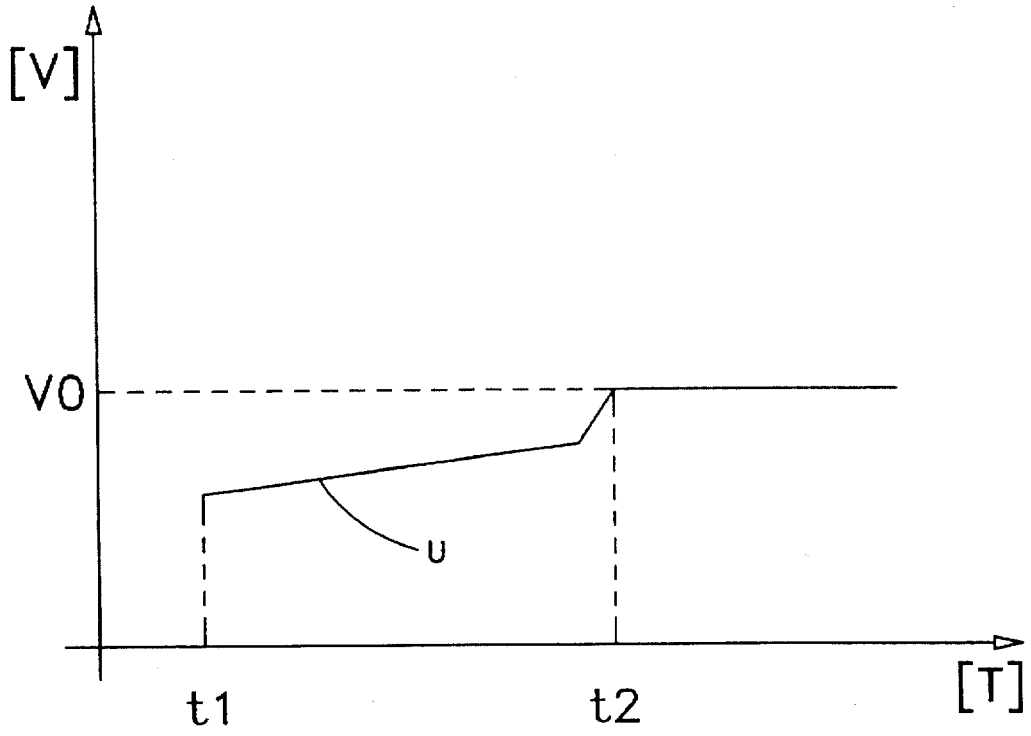

Such a further voltage signal (indicated as U in FIG. 5) is inversely proportional to the water outlet pressure of the discharge pump 18. In particular, the voltage U reaches a given value $V_0$ at the end of each water outlet phase, that is, when the discharge pump 18 starts to substantially unprime, thereby representing a reduced dynamic load for the driving motor 14. As a result, the microprocessor 26 can be easily set by anyone skilled in the art so as to switch the change-over switch 28 to its resting position when the input 31 thereof detects that the above-cited value $V_0$ has been attained. Specifically, with reference to FIG. 5, at an instant $t_1$ the program sequence control unit 8 operates the discharge pump 18 by switching the change-over switch 28 into contact with the second terminal 17 of the capacitor 15. The discharge pump is initially in an optimum priming condition and starts then to unprime in correspondence of an instant $t_2$ at which the voltage U at the first terminal 16 reaches the above-cited value $V_0$. At said instant $t_2$, therefore, the microprocessor 26 energizes the relay 29 so as to switch the change-over switch 28 to its resting position. As a result, the discharge pump 18 stops operating.

In traditional solutions, the water outlet phase has a fixed, pre-determined duration, at the end of which the discharge pump, in view of ensuring an adequate water outlet, keeps operating in a substantially unprimed state. It will be readily appreciated that this means that energy is thereby used to no avail and noise is undesirably generated in the washing machine.

On the contrary, according to the present invention the discharge pump 18 is operated in an efficient manner, whereby all of the main variables of the water flow and discharge system are duly kept into account. In particular, the operation of the discharge pump 18 is cut off as soon as the water contained in the vessel 5 is detected to have been substantially discharged, thereby avoiding a substantial, undesired generation of noise.

It can be readily appreciated that the washing machine according to the present invention makes use of simple and reliable means to optimally control both the water inlet and the water outlet phases.

It will be further appreciated that the above-described washing machine may undergo a number of modifications without departing from the scope of the present invention.

What is claimed is:

1. A washing machine provided with a dynamic water inlet control arrangement, comprising a water inlet valve that is actuated to open during at least a water inlet phase filling water into the machine; a water circulation pump for circulating water from the inlet valve; an electric motor driving the pump during at least a portion of the water inlet phase, said control arrangement being driven by a signal that is proportional to an outlet pressure of the circulation pump so as to close the inlet valve when signal variations decrease below a predetermined value, characterized in that said motor (14) is an asynchronous motor; a capacitive phase-shifter (15) is connected to motor windings for starting the motor into rotation; and the control arrangement (24, 26) is connected at a terminal (16, 17) between the phase-shifter and one of the motor windings, wherein the signal is a voltage provided by the phase-shifter.

2. A washing machine according to claim 1, characterized in that said asynchronous motor (14) is a single-phase motor.

3. A washing machine according to claim 1, further comprising a discharge pump for letting out water previously filled into the machine wherein the asynchronous motor is adapted for rotatably driving the discharge pump and is further adapted to be selectively operated to run in first and second directions of rotation in which only the circulation pump and only the discharge pump is operating, respectively, characterized in that at least one controlled change-over switch (28) controlling said selective operation of the asynchronous motor (14) is adapted to selectively provide a connection to said terminal (17) and a second terminal (16) of the capacitive phase-shifter (15), and a second signal (U) is derived at said second terminal (16) of the phase-shifter which is proportional to an outlet pressure of the discharge pump (18), said second signal driving and the control arrangement (32, 26) and de-energizing the discharge pump (18) when said second signal reaches a given value ($V_0$) corresponding with the water being substantially discharged from the machine.

* * * * *